US006006634A

United States Patent [19]

Byers

[11] Patent Number: 6,006,634

[45] **Date of Patent: *Dec. 28, 1999**

[54] SOCKET WRENCH WITH IMPACT DRIVE

[76] Inventor: William J. Byers, 25755 Zachary Ave., Elko, Minn. 55020

[ * ] Notice: This patent is subject to a terminal disclaimer.

[21] Appl. No.: 08/964,574

[22] Filed: Nov. 5, 1997

Related U.S. Application Data

[63] Continuation-in-part of application No. 08/598,569, Feb. 12, 1996, Pat. No. 5,692,420.

[51] Int. Cl.[6] ..... B25B 19/00; B25B 23/16

[52] U.S. Cl. ..... 81/465; 81/177.2

[58] Field of Search ..... 81/177.2, 466, 81/465, 463, 60–63.2, 59.1; 173/93.6, 94, 95, 96

[56] References Cited

U.S. PATENT DOCUMENTS

| | | | |
|---|---|---|---|
| 4,243,109 | 1/1981 | Anderson | 81/466 |
| 4,364,440 | 12/1982 | Clar | 173/93.7 |
| 4,455,899 | 6/1984 | Savell | 81/466 |
| 4,563,923 | 1/1986 | McDonald | 81/466 |
| 4,759,242 | 7/1988 | Andersson | 81/466 |
| 4,794,993 | 1/1989 | Swenson | 81/466 |
| 4,821,611 | 4/1989 | Izumisawa | 173/93.6 |
| 5,095,784 | 3/1992 | Garver | 81/466 |
| 5,107,727 | 4/1992 | Klefbeck | 81/466 |
| 5,109,737 | 5/1992 | Raber | 81/177.2 |
| 5,193,419 | 3/1993 | Lee | 81/177.2 |
| 5,392,673 | 2/1995 | Scott | 81/177.2 |

OTHER PUBLICATIONS

Sears Tool Catalog, 1995–1996, pp. 36–41, Copyright 1995.

*Primary Examiner*—David A. Scherbel
*Assistant Examiner*—Joni B. Danganan
*Attorney, Agent, or Firm*—James D. Christoff

[57] ABSTRACT

A socket wrench has a body with a handle, and a head with a hollow cavity. A ratchet mechanism is received in the cavity and has a drive shank for connection with a socket. The ratchet mechanism is pivotally connected to the head in order to allow the head to pivot relative to the ratchet mechanism in an arc along a limited path of travel. The pivotal connection between the head and the ratchet mechanism enables an impact force to be presented to the socket when desired. Optionally, a releasable lock member is provided to prevent relative movement of the head and the ratchet mechanism so that the socket wrench can be used in a manner similar to a conventional ratchet wrench.

19 Claims, 4 Drawing Sheets

SOCKET WRENCH WITH IMPACT DRIVE

This application is a continuation-in-part of U.S. Ser. No. 08/598,569, filed Feb. 12, 1996 now U.S. Pat. No. 5,692, 420.

BACKGROUND OF THE INVENTION

1. Field of the Invention

This invention broadly relates to a hand-held socket wrench used to tighten or loosen fasteners such as nuts, bolts and the like. More particularly, the invention relates to a socket wrench having an impact drive useful for freeing stubborn fasteners or for tightening fasteners to a relatively secure position.

2. Description of the Related Art

Socket wrenches have been long considered as highly useful tools for a variety of industrial, commercial and residential tasks. Socket wrenches typically include an elongated body having a handle at one end and a drive shank near the opposite end. The drive shank extends in a direction perpendicular to the length of the body and has an outer end section that is adapted to releasably fit into a matching hole in one end of a socket.

Sockets are available in a number of different metric and SAE sizes to fit various nuts, bolt heads and other fasteners having a hexagonal or square head. Sockets are also available with drive bits to fit Phillips, slotted or Torx head fasteners. Sockets and socket wrenches are considered economical to purchase and maintain because only one socket wrench is needed to drive any one of a number of differently-sized sockets.

Many socket wrenches include a ratchet mechanism that allows the user to advance the socket and hence the fastener in a certain rotational direction by repetitive, reciprocal motion of the handle along an arc of limited length. Ratchet drive socket wrenches are particularly useful in areas where clearance space next to the fastener is limited and the handle cannot be swung in a full, 360 degree arc. The ratchet drive is usually reversible so that the socket wrench can be used in either rotative direction as may be needed, for example, to tighten or loosen a threaded fastener.

Socket wrenches are also available with drive shanks of different cross-sectional sizes. Socket wrenches with smaller drive shanks are adapted to couple to smaller sockets for driving relatively small fasteners, while socket wrenches with larger drive shanks are adapted to couple to larger sockets for driving relatively large fasteners. Typical sizes of drive shanks include one-quarter inch square and three-eighths inch square for smaller sockets, and one-half inch square and three-quarter inch square for larger sockets.

In physics, "torque" is a force that produces or tends to produce a twisting or rotational motion. The amount of torque provided by a socket that is connected to a socket wrench is calculated by multiplying the force that the user exerts on the handle by the distance between the handle and the central, rotational axis of the drive shank of the socket wrench. Consequently, the torque provided by the socket to the fastener for any given amount of force exerted by the user on the handle can be varied by varying the distance between the handle and the drive shank.

The length of socket wrenches (i.e. the distance between the rotational axis of the drive shank and the handle) is usually chosen by the manufacturer to match the amount of torque that is expected to be needed to loosen or tighten the fasteners typically encountered during use. For example, socket wrenches with smaller drive shanks are usually coupled to smaller sockets for use with relatively small fasteners. Manufacturers often provide such socket wrenches with a body of relatively limited length so that when the user exerts a reasonable amount of force on the handle to tighten the fastener, the torque in most circumstances will not be sufficient to break the fastener.

Similarly, socket wrenches with larger drive shanks are often coupled to larger sockets for use with relatively large fasteners. Larger shank socket wrenches are normally equipped with a body having a relatively long length so that a sufficient amount of torque can be exerted on the fastener to securely tighten the fastener. In these wrenches, the distance between the handle and the rotational axis of the drive shank is sufficient to provide a satisfactory amount of torque to the socket without requiring the user to exert an undue amount of force on the handle.

Unfortunately, users of conventional socket wrenches are sometimes unable to exert a sufficient amount of force on the handle to loosen particular fasteners. For example, fasteners that have been over-tightened and fasteners that have oxidized or rusted are often difficult to loosen and remove. Rusted fasteners are often encountered when repairing automobiles, especially if the fastener is located on the underside of the automobile or in other areas where water and road salt are present. Lug nuts on older automobiles may be particularly difficult to remove. Additionally, fasteners used near a salt water environment such as those used in boats, automobiles and buildings near the ocean are highly susceptible to severe corrosion.

Other examples of fasteners that may be difficult to remove include threaded fasteners that have been coated with a thread locking compound, and fastening assemblies made of two dissimilar metals that, over time, have chemically reacted and bonded to each other. Aircraft locking fasteners, such as fasteners that include a nut having peened-over portions near the threaded bore, can also be difficult to remove.

Occasionally, attempts are made to remove stubborn fasteners by using a "breaker-bar" socket wrench having a body with a length longer than normal. The increased length of the body increases the torque applied to the fastener for a given amount of force applied to the handle by the user, and in some instances is sufficient to remove the fastener. Such socket wrenches often lack a ratchet mechanism and instead have a "T"-shaped head that is connected to the drive shank.

Unfortunately, breaker-bar socket wrenches are most often used in a manner by applying a gradually-applied force to the fastener, which may not be effective in some instances without undue effort. In addition, long breaker-bar socket wrenches cannot be used in locations where access is limited. The length of breaker-bar wrenches also sometimes facilitates slipping of the socket from the fastener, which may lead to injury to the user. Moreover, breaker-bar socket wrenches that lack a ratchet mechanism are often a nuisance to use once the fastener has been loosened, particularly in areas where there is insufficient clearance to swing the handle in a 360 degree arc. It is also somewhat time-consuming to remove the socket from the shorter socket wrench normally used and replace the shorter wrench with the longer, breaker-bar socket wrench.

Electric and air-powered impact wrenches are used by some mechanics to loosen stubborn fasteners. However, such powered wrenches are somewhat costly and cannot be used in locations where a source of power or compressed air is not available. Powered wrenches are sometimes considered too cumbersome and too powerful for use with smaller fasteners. Furthermore, if the mechanic is using a socket wrench for other fasteners, it is somewhat of a nuisance to put the socket wrench aside and retrieve the powered impact wrench each time that a stubborn fastener is encountered.

SUMMARY OF THE INVENTION

My present invention overcomes the disadvantages of conventional tools noted above by provision of a hand-powered impact socket wrench having an elongated body and a drive shank pivotally coupled to the body. The body of the wrench is freely pivotable relative to the drive shank in either direction to a limited extent along an arc that extends about a central axis of the drive shank. The wrench includes a handle, and movement of the handle in an arc about the central axis of the drive shank enables a significant amount of momentum to be obtained. Once the handle has reached the limit of its path of travel, momentum is transferred from the body to the drive shank and hence to the socket in order to direct an impact force in a rotational direction to the fastener.

In preferred embodiments of my invention, the socket wrench is provided with a ratchet mechanism and a lock to prevent free pivotal movement of the wrench body relative to the drive shank when desired. As a consequence, the socket wrench can be used in a manner similar to the use of a conventional ratchet wrench when an impact force is not needed. The user need not switch from one wrench to another when encountering stubborn fasteners and as such progress on the task at hand is not impeded.

These and other features of the invention are described in more detail in the description of the presently preferred embodiments that follows.

DETAILED DESCRIPTION OF THE PREFERRED EMBODIMENTS

Figure 1:
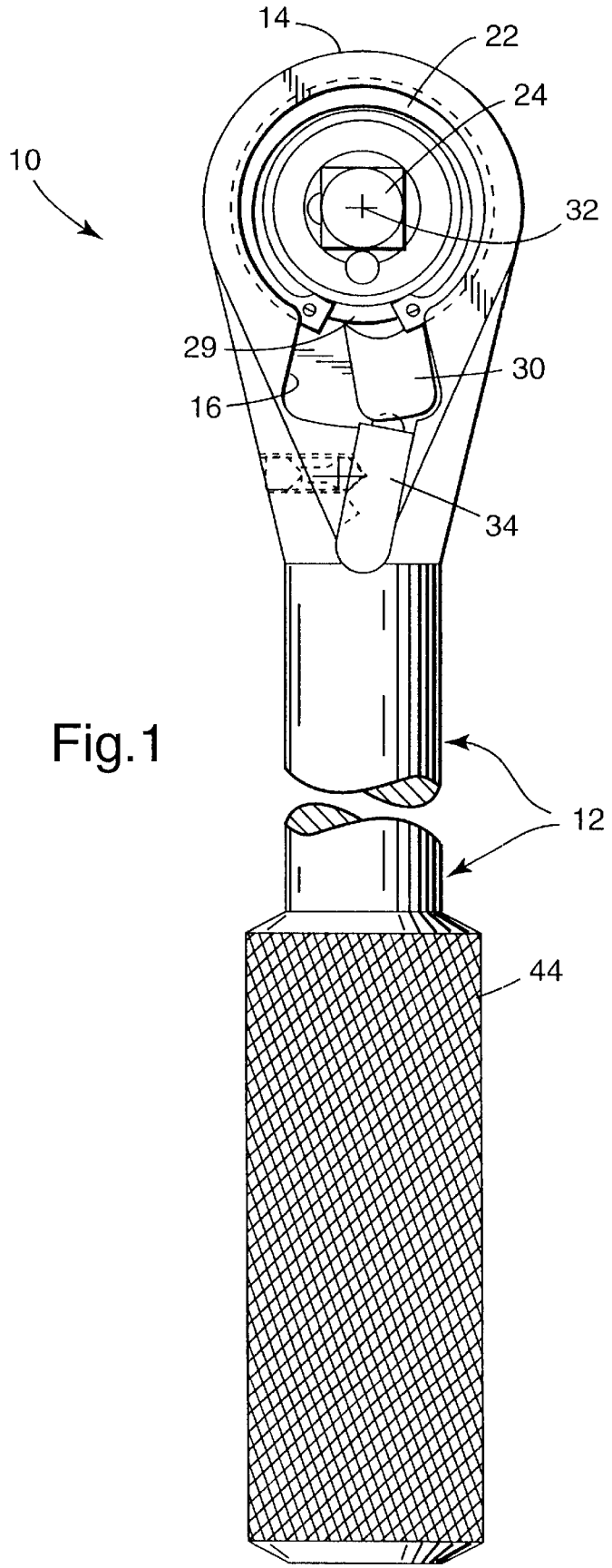
FIG. 1 is a fragmentary, front elevational view of a socket wrench constructed in accordance with the present invention.

A socket wrench that is constructed according to the principles of my invention is illustrated in FIGS. 1–4 and is designated broadly by the numeral 10. The socket wrench 10 includes an elongated body 12 having an upper, first end portion and a lower, second end portion that is remote from the first end portion. The first end portion includes a head 14 having an internal cavity 16 (FIGS. 1 and 3) that is open on the front side of the body 12.

The cavity 16 includes an upper region, a lower region and a middle region that interconnects the upper and lower region. The upper region is defined by an upper wall section having a configuration similar to the configuration of a partial cylinder. The middle region is defined by middle wall sections having a shape somewhat similar to a truncated wedge. The lower region is defined by lower wall sections that resemble a slot with a curved lower end.

A ratchet mechanism 18 is received in the cavity 16. The ratchet mechanism 18 includes a housing 20 having an outer wall portion in the shape of a partial cylinder with a diameter slightly less than the partial cylinder defined by the upper wall section of the cavity 16. The outer wall portion of the housing 20 slidably engages the surrounding, complemental upper wall section of the cavity 16.

The head 14 includes a groove that extends along a circumferential front edge portion of the upper wall section of the cavity 16. A lock ring 22 is releasably received in the groove and serves to retain the ratchet mechanism 18 in the cavity 16. The lock ring 22 is shown in FIG. 1, but is removed from FIG. 3 in order to better illustrate the outer wall portion of the housing 20 that is in sliding contact with the upper wall section of the cavity 16.

The ratchet mechanism 18 has a drive shank 24 that extends outwardly away from the head 14. An outer end section of the drive shank 24 is adapted to couple to a socket (not shown) and includes on one side a spring-loaded ball for releasably securing the socket to the drive shank 24. In the embodiment illustrated, the drive shank 24 has a square cross-sectional configuration to matingly fit into the square drive hole provided in conventional sockets although other configurations are, of course, possible.

Figure 4:
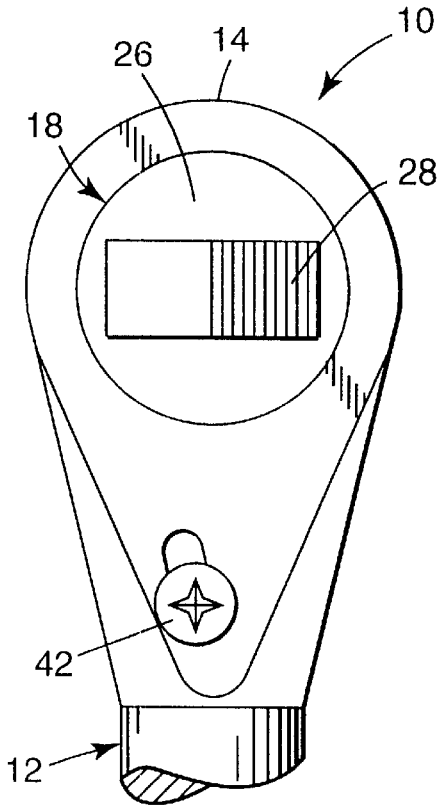
FIG. 4 is a fragmentary, rear elevational view of the socket wrench shown in FIGS. 1–2.

A rear wall 26 of the ratchet mechanism 18 extends across a rear circular opening in the head 14 adjacent the upper region of the cavity 16 and is depicted in FIG. 4. The circular opening has a diameter somewhat smaller than the diameter of the outer wall portion of the housing 20 in order to keep the ratchet mechanism 18 in the cavity 16. A tab 28 is connected to the rear wall 26 and is coupled to an internal pawl-like member of the ratchet mechanism 18. The tab 28 is movable relative to the rear wall 26 under the influence of finger or thumb pressure, and when moved is operable to reverse the ratcheting operation of the ratchet mechanism 18.

Internal details of the ratchet mechanism 18 are not shown in the drawings since the ratchet mechanism 18 may be constructed and operated in a manner identical to the ratchet mechanism of conventional, commercially-available ratchet wrenches. A presently preferred method of making the ratchet mechanism 18 involves obtaining a conventional ratchet wrench and machining the housing of the wrench to a shape of a partial cylinder that is complemental to the shape of the upper wall section of the cavity 16. An annular shim 29 (FIGS. 1 and 2 only) covers a portion of the front face of the ratchet mechanism 18 and is received in the space between the ratchet mechanism 18 and the lock ring 22.

The housing 20 of the ratchet mechanism 18 is integrally connected to a short arm 30. The arm 30 is received in the middle region of the cavity 16. Preferably, the arm 30 is constructed by removing the handle and an adjacent, lower part of the body or shaft of the conventional ratchet wrench mentioned above.

The outer wall portion of the housing 20 together with the upper wall section of the cavity 16 constitute a coupler for pivotally and slidably coupling the head 14 to the ratchet mechanism 18. The head 14 is freely pivotable relative to the ratchet mechanism 18 in either a first direction or a second, opposite direction along an arc that extends about a central axis 32 (see FIG. 2) of the drive shank 24. The axis 32 is generally perpendicular to the longitudinal axes of the body 12 and the arm 30. As the head 14 is so moved, the middle region of the cavity 16 moves relative to the arm 30.

Figure 3:
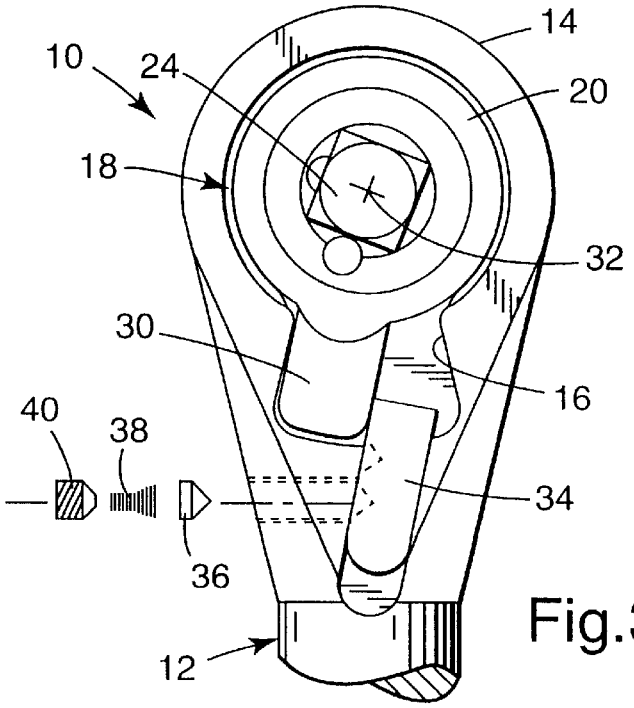
FIG. 3 is a fragmentary, front elevational view of an upper portion of the socket wrench depicted in FIG. 1 except that a lock ring has been removed to better illustrate a ratchet mechanism housing, a lock member has been shifted to a release position and a head of the wrench has been moved relative to the ratchet mechanism to a different position than is shown in FIG. 1.

The middle wall sections of the cavity 16 limit movement of the middle region of the cavity 16 relative to the arm 30, and therefore limit the extent of pivotal motion of the head 14 relative to the ratchet mechanism 18. In FIG. 1, the arm 30 is shown in a position of contact with a first or right hand wall of the middle wall sections, which represents one end of the limited path of free, unrestricted travel of the head 14 relative to the ratchet mechanism 18. The arm 30 is illustrated in FIG. 3 in a position of contact with a second or left band wall of the middle wall sections, which represents the other end of the limited path of free, unrestricted travel of the head 14 relative to the ratchet mechanism 18.

The magnitude of the limited arc of pivotal movement of the head 14 relative to the drive shank 24 (and therefore also the ratchet mechanism 18) is determined by the spacing between the opposed left and right middle wall sections, and may be varied according to the weight of the wrench 10 and the length of the body 12. As an example, when the distance between the axis 32 and the outer end of the body 12 is about 11 inches, the limited arc is preferably at least 5 degrees and more preferably at least 10 degrees. The limited arc is preferably in the range of about 5 degrees to about 45 degrees, is more preferably in the range of about 10 degrees to about 30 degrees, and is most preferably about 25 degrees. When the body 12 has a smaller length (as, for example, when the drive shank 24 is one-quarter inch square), limited arcs of greater than 45 degrees, and possibly as great as 90 degrees or 120 degrees, may be employed.

Figure 2:
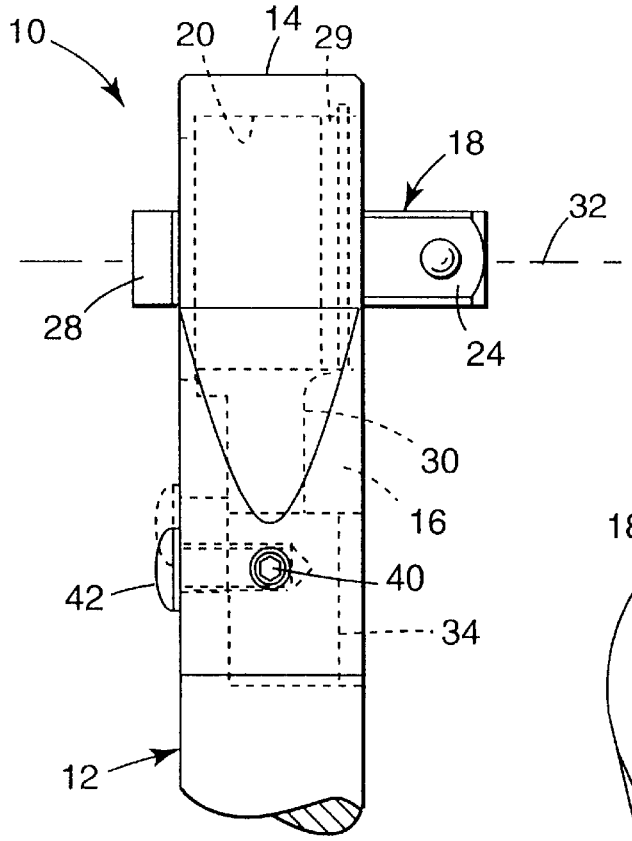
FIG. 2 is a fragmentary, side elevational view of an upper portion of the socket wrench shown in FIG. 1.

The socket wrench 10 also includes a lock for preventing pivotal movement of the head 14 relative to the ratchet mechanism 18 when desired. The lock includes a member 34 that is slidable in the lower region of the cavity 16. In FIGS. 2 and 3, the member 34 is shown in a raised or locking first position in contact with the arm 30. In the raised position of the member 34, the arm 30 is retained in a stationary position relative to the head 14 between the member 34 and the left middle wall section of the cavity 16.

In FIG. 1, the lock member 34 is shown in a lowered or released second position that is slightly spaced from a position of contact with the arm 30. Consequently, when the member 34 is in the lowered position, the arm 30 is free to move relative to the head 14 between the opposed left and right middle wall sections of the cavity 16.

A threaded bore extends between the lower region of the cavity 16 and an adjacent external side wall of the head 14. A somewhat conical-shaped latch 36 (see FIGS. 1 and 3) is received in the bore and is urged in a direction toward the lock member 34 by a small, stiff compression spring 38. A setscrew 40 is threaded into the bore a distance sufficient to bear against the spring 38 and urge the latch 36 into a position of firm but yielding contact with the lock member 34. The latch 36, the spring 38 and the setscrew 40 are shown in disassembled or exploded format in FIG. 3 for purposes of illustration.

The lock member 34 has a pair of adjacent, conical detents. When the lock member 34 is in its lowered position as illustrated in FIG. 1, the latch 36 is received in the upper detent. On the other hand, when the lock member is in its raised position as illustrated in FIG. 3, the latch 36 is received in the lower detent. The latch 36 along with the detents function to retain the lock member 34 in a selected position and releasably prevent movement of the lock member 34 relative to the head 14.

The rear wall of the head 14 includes a small slot that is partially shown in FIG. 4. An operating button 42, comprising a Phillips head bolt, has a shank that extends through the slot and is threaded into a bore of the lock member 34. The head of the button 42 is shown in FIGS. 2 and 4 and can be moved by finger or thumb manipulation between the full line position and the dashed line position illustrated in FIG. 2 in order to slide the lock member 34 between its lowered position and its raised position respectively.

Finally, the lower end portion of the body 12 includes a handle 44 that is depicted in FIG. 1. The handle 44 preferably has a knurled surface adapted to facilitate the user's grip on the socket wrench 10. Preferably, the handle 44 has a significant weight that helps to provide a greater impact force as will be explained below. The length of the body 12 and the weight of the handle 44 may vary, but preferably are selected to provide optimal impact force when needed without undue length of the body 12 that might otherwise restrict access to the fastener and without undue weight of the body 12 that might otherwise cause operator fatigue.

In use, a socket of the correct size is selected and then coupled to the drive shank 24 of the socket wrench 10. In instances where the fastener is not difficult to remove or where an impact force is not desired to tighten the fastener in place, the lock member 34 is placed in its upper position as shown in FIG. 3 in contact with the arm 30 in order to preclude movement of the head 14 relative to the ratchet mechanism 18. When the lock member 34 is in the upper position, the socket wrench 10 functions in a manner similar to a conventional ratchet wrench. Movement of the tab 28 allows the user to change the operation of the ratchet mechanism 18 according to whether tightening or untightening of the fastener is desired.

However, when a fastener that is difficult to remove is encountered or when an impact force is desired to tighten a fastener in place, the lock member 34 is shifted to its lower position as illustrated in FIG. 1. In the lower position, the lock member 34 is out of contact with the arm 30 and the head 14 is free to pivot relative to the ratchet mechanism 18 about the pivot axis 32.

For example, if a rusted fastener having a conventional right-handed thread is to be removed from a threaded bore, the tab 28 is first shifted as needed to ensure that ratcheting motion will not occur when the handle 44 swung in an arc about the pivot axis 32 in a clockwise direction (viewing FIG. 1). Next, the user "retracts" the orientation of the body 12 if needed by swinging the handle 44 in an arc about the pivot axis 32 in a counterclockwise direction (viewing FIG. 1) relative to the ratchet mechanism 18 in order to bring the left side of the arm 30 to a position next to the left middle wall section of the cavity 16 as shown in FIG. 3. The ratchet mechanism 18 enables the user to optionally move the body 12 further in the same counterclockwise arc in order to improve access to the handle 44 or maneuverability of the body 12 during subsequent motion.

Next, the handle 44 is swung in an arc about the pivot axis 32 in a clockwise direction viewing FIG. 1 to remove the fastener. Initially, as the handle 44 so moves, the socket as well as the drive shank 24 remain stationary relative to the fastener as the head 14 pivots relative to the ratchet mechanism 18. However, once the right middle wall section of the cavity 16 has contacted the right side of the arm 30 as shown in FIG. 1, the head 14 is operable to drive the ratchet mechanism 18 and as a result the head 14 and the ratchet mechanism 18 move together at a common rotational velocity during any further movement of the handle 44 in the same clockwise direction. Momentum obtained by swinging, clockwise motion of the handle 44 is transferred to the ratchet mechanism 18 and hence to the socket such that an impact "blow" is exerted to the fastener.

The above motions can be repeated as needed to further loosen the fastener. Moreover, corresponding motions of the handle 44 in an opposite direction may be carried out in order to use an impact force to securely tighten a fastener when desired. Once the impact force is unnecessary, the lock member 34 is shifted to its upper position as depicted in FIG. 3 in order to enable the socket wrench 10 to function in a manner similar to a conventional ratchet wrench.

Figure 5:
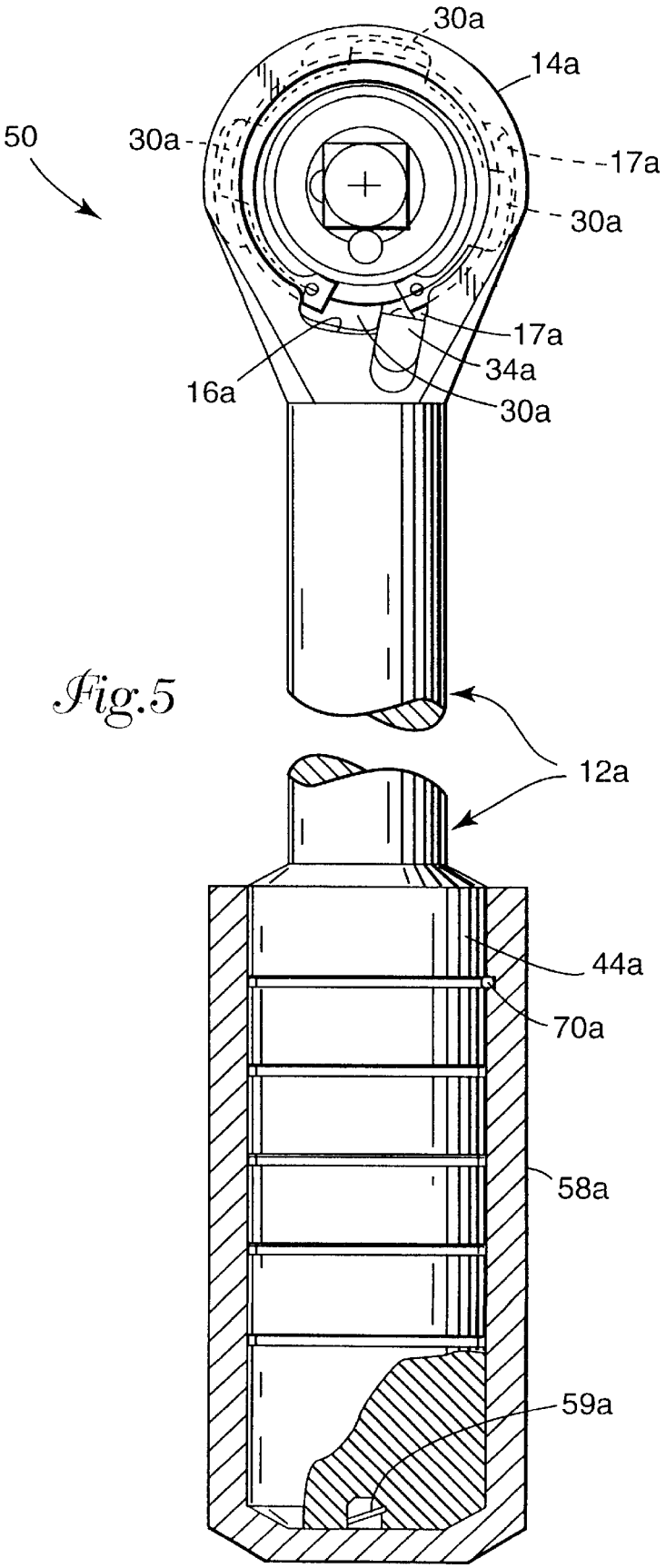
FIG. 5 is a fragmentary, front elevational view in partial section of a socket wrench constructed in accordance with another embodiment of the invention.

A socket wrench that is constructed in accordance with another embodiment of my invention is illustrated in FIG. 5 and is designated broadly by the numeral 50. Except as mentioned below, the wrench 50 is identical in construction and function as the wrench 10 described above.

The wrench 50 has a plurality of identical arms 30*a* that are integrally connected to a housing of a ratchet mechanism. In the particular embodiment shown in FIG. 5, the wrench has four arms 30*a* although a greater number or a smaller number of arms may also be employed. The housing and ratchet mechanism are not numbered in FIG. 5 but are identical to the housing 20 and ratchet mechanism 18 respectively described above. The arms 30*a* extend radially outwardly from the housing and are spaced an equal distance apart from each other. Each arm 30*a* is similar to the arm 30 in FIGS. 1–3 but somewhat smaller in length (i.e. in a direction radially outwardly from the housing) than the arm 30.

The head 14*a* is somewhat identical to the head 14 but includes a cavity 16*a* having a plurality of arm-receiving cavity regions 17*a* instead of the single arm-receiving cavity region mentioned above with respect to the cavity 16. The head 14*a* shown in FIG. 5 has four cavity regions 17*a*, although the number of such regions 17*a* could be more or less than four and preferably is equal to the number of arms 30*a*. The cavity regions 17*a* each include a first wall section and a second wall section opposed from the first wall section. Each arm 30*a* is received in a respective cavity region 17*a*. The opposed wall sections of each cavity region 17*a* are spaced apart from each other an equal distance in the vicinity of the arms 30*a*. Each cavity region 17*a* communicates with a central cylindrical cavity region that slidably and pivotally receives the ratchet mechanism.

A lock member 34*a* is similar to but somewhat longer in length than the lock member 34. In FIG. 5, the lock member 34*a* is shown in a raised, locking position in contact with one of the arms 30*a* for retaining the arm 30*a* and consequently the ratchet mechanism in a stationary position relative to the body 12*a*. When the lock member 34*a* is lowered to a position spaced from the adjacent arm 30*a*, the arms 30*a* are free to move in their respective cavity regions a limited extent which is equal to the available distance between the opposed first and second wall sections. Advantageously, the relative short arms 30*a* in combination with the relatively small cavity regions 17*a* enables the head 14*a* to be less bulky in the vicinity of the lock member 34*a* in comparison to, for example, the head 14 shown in FIGS. 1–4.

An auxiliary weight 58*a* in the shape of a sleeve with one closed end has an internal cylindrical compartment that removably receives the handle 44*a*. An outer cylindrical surface of the weight 58*a* presents a second handle and is preferably constructed to facilitate the operator's grip on the wrench 50. For example, the outer surface or handle could be grooved, contoured and/or knurled. The weight 58*a* advantageously increases the mass of the wrench 50 in the vicinity of the handle 44*a* as may be desired in certain instances when a particularly stubborn fastener is encountered or in any other instance when additional torsional force is needed.

The wrench 50 includes a catch 70*a* for releasably retaining the weight 58*a* in place and connected to the handle 44*a*. In the illustrated embodiment, the catch 70*a* includes a retained ball that is retained in a recess formed in the weight 58*a* and a spring that urges the ball toward the handle 44*a*. The handle 44*a* includes a series of circumscribing, spaced-apart grooves and the ball is engageable with a selected groove in order to releasably fix the weight 58*a* in place in any one of a number of positions relative to the handle 44*a*. The distal groove is preferably located a suitable distance from the distal end of the handle 44*a* to provide a safe overlap between the weight 58*a* and the handle 44*a* in any relative position whenever the catch 70*a* is received in a groove.

Other types of catches may be substituted for the illustrated catch 70*a*. Suitable catches include, for example, a pin, bolt or other coupling. Alternatively, the surfaces of the weight 58*a* and handle 44*a* that contact each other when the weight 58*a* is received on the handle 44*a* could have a close, mating fit to releasably retain the weight 58*a* in the selected position relative to the handle 44*a*. Optionally, the auxiliary weight 58*a* could be longer than that shown in FIG. 5 and thereby enhance the amount of available impact or momentum force of the wrench 50.

Preferably, the closed end of the weight 58*a* includes an inwardly-extending threaded portion 59*a* and an outer end wall of the handle 44*a* includes a mating threaded bore. When the weight 58*a* is moved over the handle 44*a* in a direction toward the head 14*a*, the threaded portion 59*a* moves into the threaded bore. Twisting the weight 58*a* by, for example, a quarter or half turn relative to the handle 44*a* causes the threaded portion 59*a* to rotate into the bore and releasably lock the weight 58*a* to the handle 44*a*. Preferably, once the threaded portion 59*a* is fully inserted into the bore the catch 70*a* is fully seated into the adjacent groove. The closed end of the weight 58*a* has a vent hole to permit the escape of air as the weight 58*a* is moved toward the head 14*a*.

The body 12*a* has a first end portion that includes the head 14*a* and a second end portion remote from the first end portion. Advantageously, the weight 58*a* provides a convenient structure for lengthening the second end portion of the body 12*a* when desired. The weight 58*a* that includes the second handle comprises a first section, and the handle 44*a* comprises a second section fixedly connected to the first end portion of the body 12*a*. As such, the first section is selectively movable either toward or away from the second section in order to vary the distance between the second handle and the head 14*a*. Moreover, the weight 58*a* can be detached from the handle 44*a* and the wrench 50 used without the weight 58*a* when desired.

Figure 6:
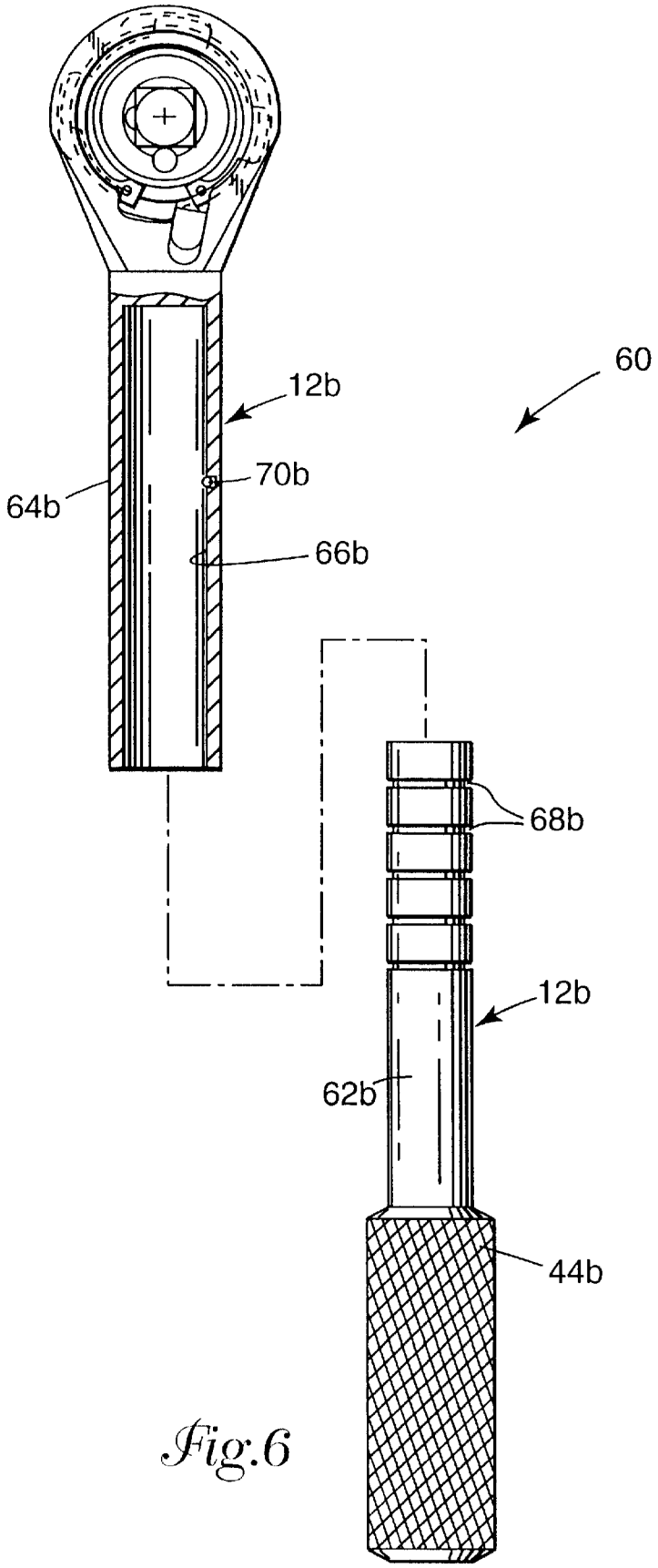
FIG. 6 is a reduced, front elevational view in partial section showing a disassembled socket wrench that is constructed according to yet another embodiment of the invention.

A socket wrench 60 according to another embodiment of the invention is identical to the socket wrench 50 described above except for the differences set out below. As illustrated in FIG. 6, the body 12*b* of the wrench 60 has a second end portion with a first section 62*b* and a separate second section

64*b*. The first section 62*b* presents a handle 44*b* and the second section 64*b* is fixedly connected to the first end portion of the body 12*b*.

The second section 64*b* has a hollow compartment 66*b* with a cylindrical bore. The compartment 66*b* removably receives a cylindrical extension of the first section 62*b*. The cylindrical extension is slidably movable in the compartment 66*b* in directions either toward or away from the ratchet mechanism in order to selectively vary the distance between the head of the wrench 60 and the handle 44*b*.

The cylindrical extension includes a series of spaced apart circumferential grooves 68*b* that are remote from the handle 44*b*. The second section 64*b* includes a catch 70*b* that comprises a retained ball and a spring similar to the catch 70*a*. The ball is engageable with a selected groove 68*b* for releasably fixing the distance between the handle 44*b* and the head. Other types of catches such as a pin or bolt fastener or frictional mating surfaces are also possible.

Preferably, a vent hole (not shown) is located in the first or second section to relieve air that might otherwise hinder movement of the extension into the compartment 66*b*. Alternatively, a number of removable first sections of varying lengths and/or weights may be provided, so that the user has a choice of mass and length to optimize use of the wrench 60. As another alternative, the first section may be connected to the second section by a threaded connection so that rotation of the handle relative to the head serves to vary the distance between the handle and the head. Moreover, the concepts embodied in FIGS. 5 and 6 may also be employed in conjunction with the wrench 10 shown in FIGS. 1–4.

Those skilled in the art may appreciate that various modifications and additions may be made to the socket wrench described above without departing from the spirit of my invention. For example, the ratchet mechanism 18 and the arm 30 may be replaced with a similarly-shaped piece that lacks a ratchet mechanism but includes a drive shank and an arm similar to the drive shank 24 and the arm 30. The drive shank and arm of such a piece are fixedly connected to, and preferably integral with, an outer wall portion that is similar in size and configuration to the outer wall portion of the housing 20. Such construction is advantageous in instances where an extremely durable wrench is needed. The piece may be easily replaced with the ratchet mechanism 18 by removal of the lock ring 22 when desired.

A variety of other constructions are also possible. Consequently, the invention should not be deemed limited to my presently preferred embodiments that are set out above in detail, but only by a fair scope of the claims that follow along with their equivalents.

I claim:

1. A socket wrench comprising:

an elongated body having a first end portion and a second end portion remote from said first end portion, said first end portion including a head, said second end portion including a handle;

a drive shank having an outer end section for releasably connecting to a socket, said drive shank including a central axis extending in a direction generally perpendicular to the longitudinal axis of said body; and a coupling for pivotally connecting said drive shank to said head, said coupling enabling said head to freely pivot relative to said drive shank in either a first or second direction to a limited extent along an arc that extends about said central axis of said drive shank, said coupling including at least one cavity region having opposed wall sections and at least one arm received in said at least one cavity region between said opposed wall sections, said at least one cavity region being fixed to one of said body and said drive shank, said at least one arm being fixed to the other of said body and said drive shank, said at least one arm and said at least one cavity region being relatively movable, said at least one arm being in abutting contact with a respective first wall section once said head has reached the end of said limited extent for driving said drive shank at the same rotational velocity of said head in said first direction, said at least one arm being in abutting contact with a respective second wall section once said head has reached the other end of said limited extent for driving said drive shank at the same rotational velocity of said head in said second direction, and wherein said coupling includes a releasable lock for preventing pivotal movement of said head relative to said drive shank in at least one direction along said arc when desired.

2. The socket wrench of claim 1, wherein said wrench includes a ratchet mechanism that includes said drive shank.

3. The socket wrench of claim 2, wherein said ratchet mechanism includes a housing and wherein said body includes a central cavity region that receives said ratchet mechanism.

4. The socket wrench of claim 3, wherein said central cavity region includes a wall section having a partially cylindrical configuration, and wherein said housing includes a wall portion having a partially cylindrical configuration complemental to said configuration of said partially cylindrical wall section, said wall portion being received in said central cavity region, said partially cylindrical wall section moving relative to said wall portion in an arc about said central axis of said drive shank as said head is pivoted relative to said drive shank.

5. The socket wrench of claim 2, wherein said ratchet mechanism includes selectively reversible structure for rotatably driving said drive shank in either direction about said central axis.

6. The socket wrench of claim 1, wherein said lock includes a member movable in one of said at least one cavity region between a first position in contact with one of said at least one arm and a second position spaced from said one arm.

7. The socket wrench of claim 1, wherein said arc is in the range of about 5 degrees to about 45 degrees.

8. The socket wrench of claim 1, wherein said arc is at least 10 degrees.

9. The socket wrench of claim 1, wherein said at least one cavity region includes a plurality of distinct cavity regions, wherein said at least one arm includes a plurality of arms, and wherein each of said distinct cavity regions includes a respective arm.

10. The socket wrench of claim 1, wherein said second end portion of said body includes a first section that includes said handle and a second section fixedly connected to said first end portion, said first section being selectively movable either toward or away from said second section in order to vary the distance between said head and said handle.

11. The socket wrench of claim 10, and including a releasable catch for substantially preventing movement of said first section relative to said second section when desired.

12. The socket wrench of claim 1, and including an auxiliary weight removably connected to said handle for increasing the mass of said second end portion when desired.

13. The socket wrench of claim 12, wherein said handle has a generally cylindrical configuration and wherein said auxiliary weight has a generally cylindrical configuration with an internal generally cylindrical compartment that receives said handle.

14. A socket wrench comprising:

an elongated body having a first end portion and a second end portion remote from said first end portion, said first end portion including a head, said second end portion including a handle;

a ratchet mechanism including a drive shank having an outer end section for releasably connecting to a socket, said drive shank including a central axis extending in a direction generally perpendicular to the longitudinal axis of said body; and a coupling for pivotally connecting said ratchet mechanism to said head, said coupling enabling said head to freely pivot relative to said ratchet mechanism in either a first or second direction to a limited extent along an arc that extends about said central axis of said drive shank, said coupling including at least one cavity region having opposed wall sections and at least one arm received in said at least one cavity region between said opposed wall sections, said at least one cavity region being fixed to one of said body and said drive shank, said at least one arm being fixed to the other of said body and said drive shank, said at least one arm and said at least one cavity region being relatively movable, said at least one arm being in abutting contact with a respective first wall section once said head has reached the end of said limited extent for driving said ratchet mechanism and thereby said drive shank at the same rotational velocity of said head in said first direction, said at least one arm being in abutting contact with a respective second wall section once said head has reached the other end of said limited extent for driving said ratchet mechanism and thereby said drive shank at the same rotational velocity of said head in said second direction.

15. The socket wrench of claim 14, wherein said arc is at least 10 degrees.

16. The socket wrench of claim 14, wherein said at least one cavity region includes a plurality of distinct cavity regions, wherein said at least one arm includes a plurality of arms, and wherein each cavity region receives a respective arm.

17. The socket wrench of claim 14, wherein said second end portion of said body includes a first section that includes said handle and a second section fixedly connected to said first end portion, said first section being selectively movable either toward or away from said second section in order to vary the distance between said head and said handle.

18. The socket wrench of claim 17, and including a releasable fastener for substantially preventing movement of said first section relative to said second section when desired.

19. The socket wrench of claim 14, and including an auxiliary weight removably connected to said handle for increasing the mass of said second end portion when desired.

* * * * *